United States Patent [19]

Clover et al.

[11] Patent Number: 4,655,361

[45] Date of Patent: Apr. 7, 1987

[54] CONTAINMENT TANK

[76] Inventors: Norvin Q. Clover; Daniel S. Clover, both of 42 Highland Dr., West Caldwell, N.J. 07006

[21] Appl. No.: 815,829

[22] Filed: Jan. 3, 1986

[51] Int. Cl.[4] ..... B65D 25/24

[52] U.S. Cl. ..... 220/85 F; 220/18; 220/86 R

[58] Field of Search ..... 137/371; 141/86; 220/85 F, 86 R, 18

[56] References Cited

U.S. PATENT DOCUMENTS

| | | | |
|---|---|---|---|
| 1,131,102 | 3/1915 | Aldrich | 220/18 X |
| 1,951,645 | 3/1934 | Boosey | 220/86 R X |
| 3,972,440 | 8/1976 | Warren | 220/18 |
| 4,491,147 | 1/1985 | Argandona | 220/18 X |
| 4,520,852 | 6/1985 | Klein | 138/89 X |
| 4,527,708 | 7/1985 | Dundas et al. | 220/85 F X |
| 4,535,908 | 8/1985 | Dabich | 220/18 |
| 4,570,812 | 2/1986 | Curtis | 220/18 X |

*Primary Examiner*—Steven M. Pollard
*Attorney, Agent, or Firm*—Edward R. Weingram

[57] ABSTRACT

A secondary containment tank and ground level manhole cover provide access to a fill pipe for a main underground storge tank and prevent overflow of excess volatile liquid such as gasoline into the ground. The containment tank includes an upper ring or rim secured on an in-ground vertical skirt supported in a concrete base. An inner container is secured to the vertical skirt and has an open end adjacent to the upper ring. The cover fits into and is supported on a horizontal flange or step of the upper ring over the opening of the inner container and includes a vertical ring extending downwardly from the underside of the cover into a space between the inner container and vertical skirt. The vertical ring on the cover extends below the level of the container opening and thus bypasses any surface water leakage through the upper ring around the cover into the space adjacent to the container and into the ground below. The upper containment tank also includes means such as a manually operable sump pump or drain valve to empty excess liquid into the fill pipe of the main storage tank.

18 Claims, 5 Drawing Figures

CONTAINMENT TANK

BACKGROUND OF THE INVENTION

1. Field of the Invention

This invention relates to an auxiliary tank for collecting excess volatile liquids, such as gasoline, during the filling of an underground storage tank and particularly to a containment tank which prevents seepage of such liquids into the ground, and a cover which prevents surface water from entering the containment tank.

2. Description of the Relevant Art

Presently known auxiliary holding tanks for catching spillage of gasoline when filling main storage tanks include small cylindrical upper containers mounted around the fill pipes for the main underground storage tanks with an opening at ground level closed by a manhole cover. The cover may have no seal around the rim, may have a resilient O-ring seal to prevent water leakage into the tank, or may have a skirt which admits water but traps air in the container to prevent water from entering the fill pipe. Additional seals are provided between the fill pipe and the bottom of the container to prevent gasoline from entering the ground below the tank while permitting movement due to varying weather conditions. Drain pipes are also employed to empty the excess gasoline into the fill pipe and main tank. Examples of such devices are found in U.S. Pat. No. 4,520,852, 4,491,147, 4,278,115 and 4,457,349, with a commercially available device known as the OPW 84 Series Spill Container being manufactured by the Dover Corporation of Cincinnati, Ohio. Another more recent commercial device is a containment box manufactured by CNI Manufacturing of Irwindale, Calif., which includes a cover that does not permit entry of water into the containment area. None of these devices, however, include a simplified structure which permits surface water to be bypassed around the cover into a space between an inner container and outer skirt and cover support into the ground with means extending across the space to secure the inner container to the outer skirt and cover support, and also permits use of larger size tanks having extended upper plates with a relatively small area cover spaced from the outer rim.

SUMMARY OF THE INVENTION

It is, therefore, a primary object of the present invention to provide an improved secondary containment tank for preventing overflow of excess volatile liquids into the ground during the filling of a main underground storage tank.

It is another object of the invention to provide a containment tank which has a cover that prevents surface water from entering the tank.

It is also an object of the invention to direct surface water around the cover into a space between an inner container and outer skirt and cover support with securing means extending across the space.

An added object of the invention is to provide a means for supporting the outer skirt in a surrounding concrete base and which may also serve to secure the skirt to the inner container.

A further object of the invention is to provide a containment tank of increased size and capacity by use of a large upper plate mounted on an outer skirt with a small cover spaced from the rim of the tank.

A still further object of the invention is to provide a resilient seal between the bottom of the containment tank and the fill pipe to prevent leakage of liquid into the ground while permitting vertical movement of the tank along the pipe under varying temperature conditions.

An additional object of the invention is to provide apparatus within the containment tank for emptying excess liquid into the fill pipe of the main storage tank or directing it externally.

These objects are achieved with a novel containment tank structure which includes an in-ground vertical skirt having an upper ring or rim supported in a concrete base. An inner container spaced from the skirt is secured at several peripheral locations extending across the space to the vertical skirt and has an open end close to the upper ring. A manhole cover fits into the upper ring and is supported on a step or horizontal flange of the ring over the the open end of the container. The cover includes a thin vertical ring extending downwardly from the underside of the cover into the space between the vertical skirt and inner container and below the level of the open end. The vertical ring thus prevents surface water from entering the container by bypassing the water leaking through the upper ring around the cover into the space between the skirt and container and into the ground below. The skirt may include peripheral brackets or angles supporting the skirt and containment tank in the concrete base and having an extension across the space at the lower end securing the skirt to the inner container. A manually operable sump pump or drain valve provides a connection to the fill pipe to empty excess liquid from the upper tank into the main storage tank or to direct the liquid externally. The bottom of the container includes a double gasket seal secured around the fill pipe to prevent volatile liquid from entering the ground while permitting vertical movement of the container along the pipe during changing weather and temperature conditions. Large size containment tanks of cylindrical or rectangular shapes can be provided by use of an extended horizontal steel plate secured on the upper rim of the vertical skirt in place of the ring. The cover and opening may be positioned in a smaller area of the plate spaced from the outer rim. Other objects and advantages will become apparent from the following description in conjunction with the accompanying drawings.

DESCRIPTION OF THE PREFERRED EMBODIMENTS

Figure 1:
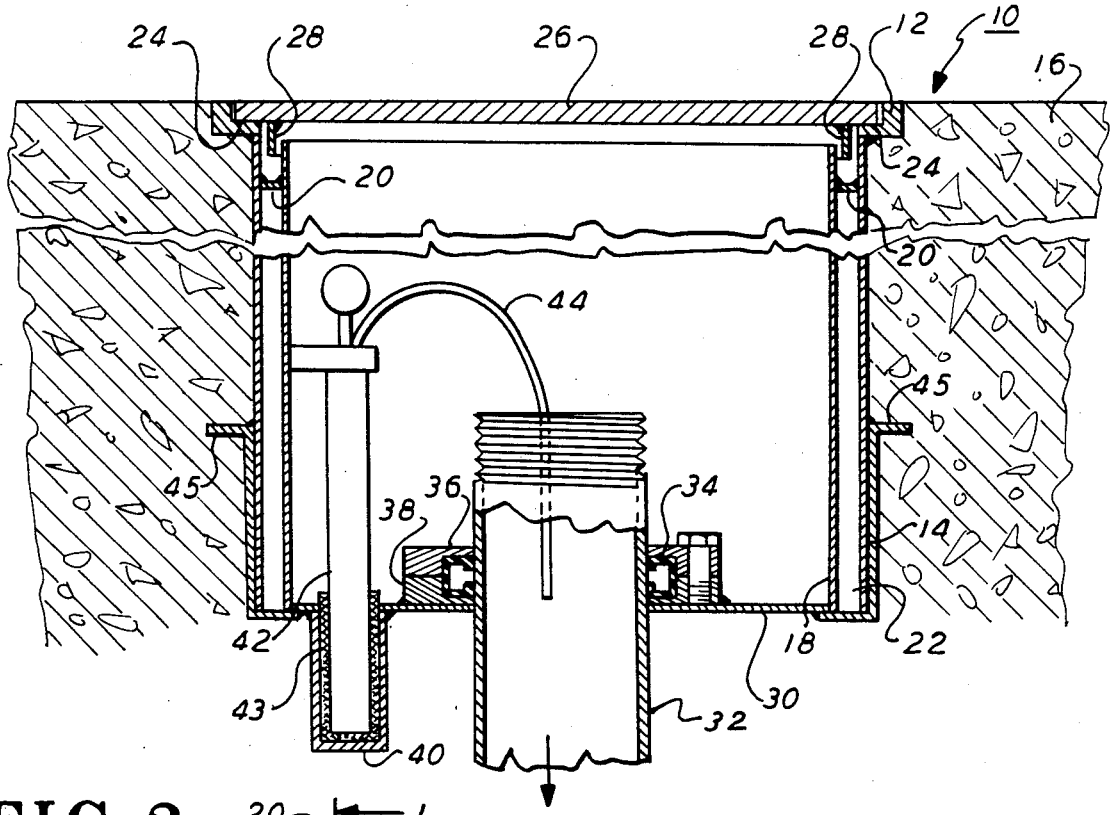
FIG. 1 is a side view in cross-section of one embodiment of the upper containment tank and manhole cover of the present invention.
Figure 2:
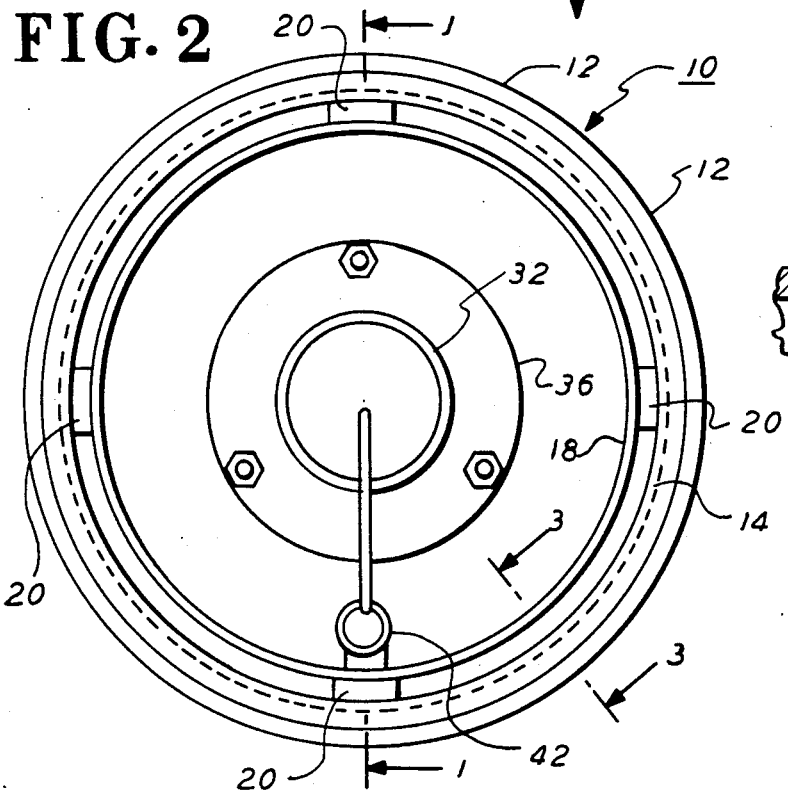
FIG. 2 is a top view of the embodiment of FIG. 1 showing the containment tank with the cover removed.

As shown in FIG. 1, a cylindrical containment tank 10 for volatile liquids, such as gasoline, includes an upper metal ring or rim 12 at ground level welded to an outer metal skirt 14 supported in a concrete base 16 extending along the skirt below ground. An inner container 18, preferably of stainless steel, is secured to the skirt by four small upper peripheral tabs 20 welded to the container and skirt and providing a small cylindrical space or passage 22 between the container and skirt which is unobstructed except for the tabs. Ring 12 includes an inward horizontal step or flange 24 which provides a support to receive a metal manhole cover 26 over the open end of the skirt and inner container 18. Cover 26 includes a thin metal ring 28 welded to the underside of the cover and extending downwardly into the space 22 between the container 18 and skirt 14 above the location of the tabs and below the level of the open end of the container 18.

Figure 3:
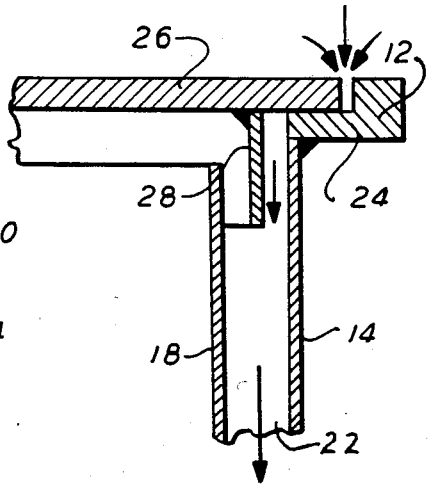
FIG. 3 is an enlarged cross-sectional view of a portion of the upper ring and cover of FIG. 1 showing the bypassing of water around the cover and inner container.

As shown in further detail in FIG. 3, surface water, such as rain, which may leak around the edges of the cover, will be prevented from entering the inner container 18 and will be bypassed into the space 22 between container 18 and skirt 14 by the ring 28, as indicated by the arrows. The water will thus be directed into the ground below the containment tank and will not mix with the volatile liquid held in the tank.

The bottom enclosed end 30 of inner container 18 includes an opening for a fill pipe 32 which leads to the main underground storage tank. A resilient ring-shaped hollow double gasket 34 having two inner spaced surfaces fits tightly around the pipe to prevent leakage of volatile liquid from the container into the ground. A pair of metal rings 36 and 38 having opposing steps, fit around the gasket to hold it securely in place. The lower ring 38 is welded to the bottom of the container and the upper ring bolted to the lower ring. In addition to the sealing action of the gasket and rings, some vertical movement of the pipe with respect to the container is accommodated. This occurs during varying weather and temperature conditions, such as freezing of the ground, which results in vertical movement of the underground tank and pipe. The pipe is thus permitted to slide up and down to a limited degree within the rings and gasket while the double gasket maintains the seal. The bottom of the container also includes a small sump basin 40 for collecting the volatile liquid and a manually operable sump pump 42, including a screen 43 for removing particulates, and a flexible hose 44, which permit emptying of the container and pumping of the liquid into the fill pipe for the main storage tank. The hose can also be used to pump the liquid out of the tank, if so desired.

Peripheral supporting angle members 45, having outwardly directed transverse extensions, may be welded along the outside of the skirt 14 to anchor the skirt and containment tank in the concrete base. The lower end of the angle members may also have inwardly directed transverse extensions which project across the space between the skirt and inner container 18 and are welded thereto to secure the elements together in place of tabs 20.

Typical dimensions of the container may include a 12-inch inner diameter for the skirt 14, an 11-inch I.D. for inner container 18 having a height of about 12 inches, and a 14 gauge thickness, a 13 inch diameter for cover 26, and a 14 inch diameter for ring 12.

Figure 4:
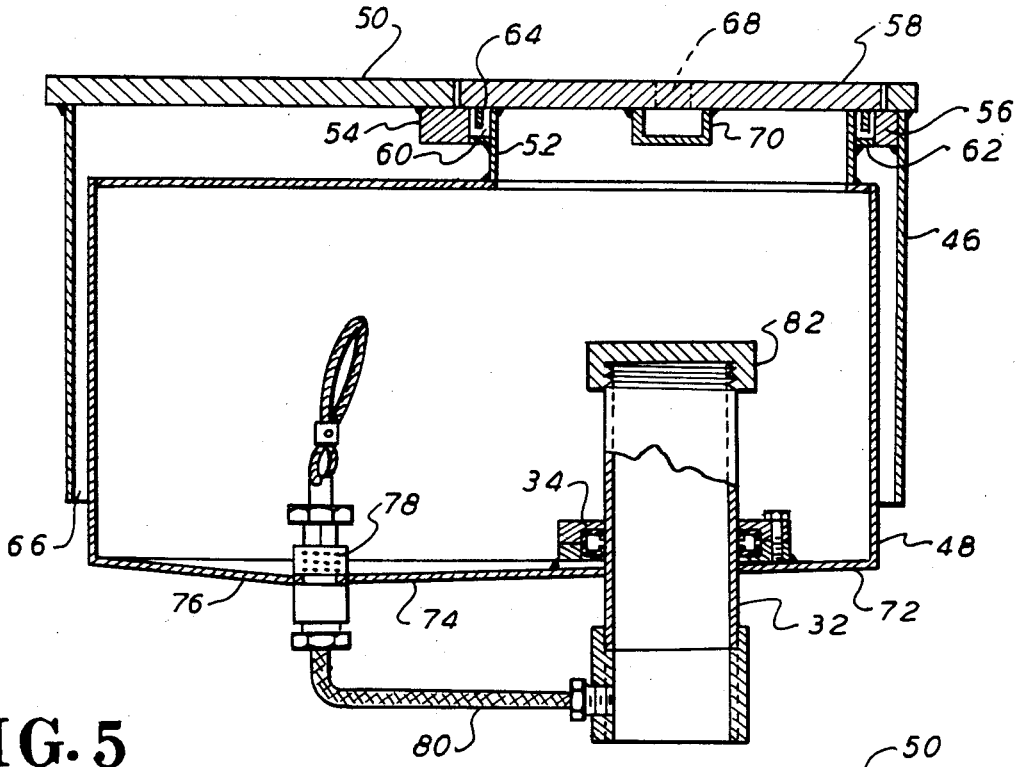
FIG. 4 is a side view in cross-section of a second embodiment of the containment tank having an enlarged upper plate and smaller manhole cover.
Figure 5:
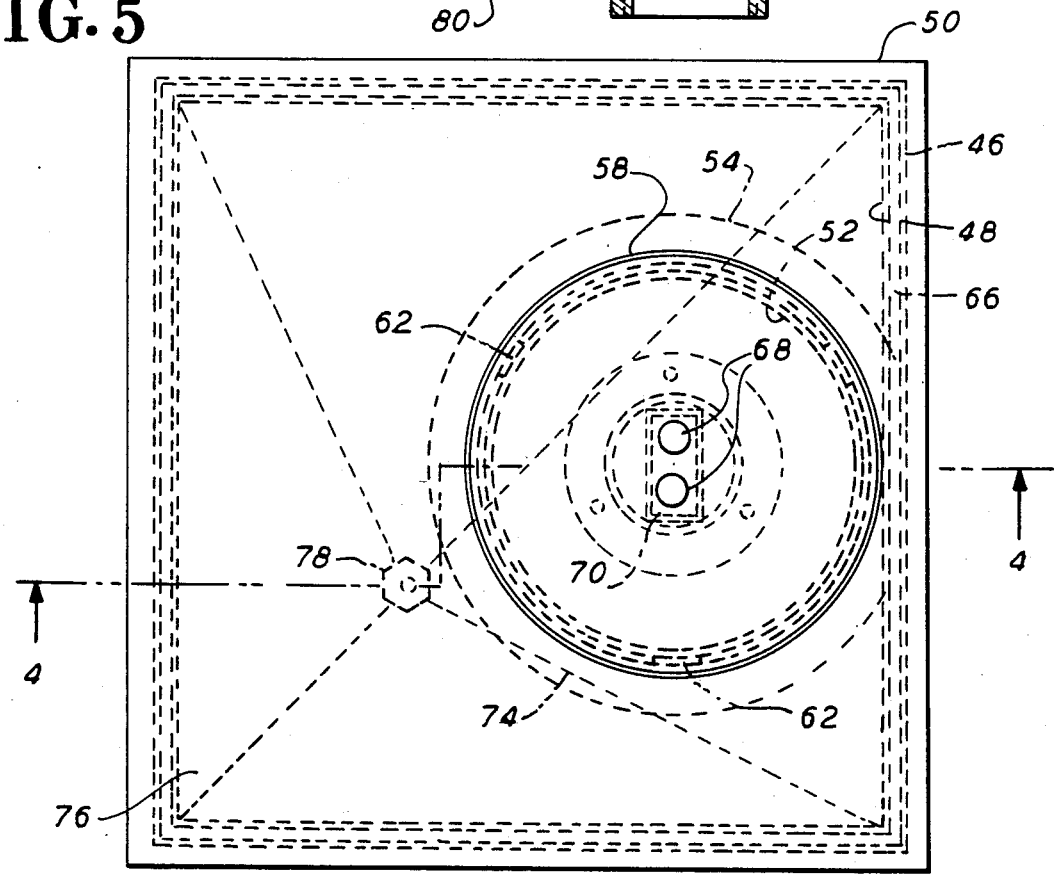
FIG. 5 is a top view of the embodiment of FIG. 4.

FIGS. 4 and 5 show another embodiment of the containment tank including a rectangular shaped skirt 46 and inner container 48, preferably of stainless steel, having an extended larger size upper rectangular plate 50 welded to the top of the skirt. The container includes a smaller cylindrical vertical open end 52 closer to one side and offset from the center of the container. An inner ring 54 is welded to the underside of the upper plate 50 and extends around the opening 52 with a peripheral portion being made narrower at one side 56 where it is welded to the skirt 46. Ring 54 provides a ledge for a supporting the smaller cover 58 over the open end 52 offset from the center and provides a peripheral space 60 around the cylindrical open end. Ring 54 is also secured to the open end 52 at peripheral locations 62 such as by welded tabs. Cover 58 includes a thin ring 64 which extends downwardly into space 60. As described in connection with FIG. 1, surface water which may penetrate around the cover into space 60 is prevented from entering the inner container 48 by ring 64 which directs the water into the ground through the peripheral space 66 between the container 48 and skirt 46. Cover 58 also includes a pair of small openings 68 providing access for inserting fingers or tools to permit removal of the cover. A rectangular enclosure 70, preferably of stainless steel, below the openings, prevents water or other debris from entering the container. The container may also be made in a round cylindrical shape and in many different sizes to accommodate varying requirements.

The bottom wall 72 of container 48 includes a fill pipe 32, double gasket seal 34 and rings 36, 38 securing the seal and pipe, as described in the embodiment of FIG. 1. The bottom wall also includes sloping surfaces 74, 76 including channels at the joining surfaces which direct liquid flow toward a drain valve 78. The valve is manually operable to open a spring biased normally closed passage to drain pipe 80 which empties liquid from the container into the fill pipe leading to the main underground storage tank. When not in use, the fill pipe is preferably closed by a suitable threaded cap 82. Typical dimensions may include a 2 ft. by 2 ft. square plate 50, a 13 ½-inch diameter cover 58 having a center offset from the center of the plate by 4 ½ inches, opening 52 having an 11-inch diameter, skirt 46 a height of 12 inches, and a container 48 a height of

15 inches.

The present invention thus provides an improved containment tank and manhole cover which prevents spillage of volatile liquids, such as gasoline or other petroleum products, into the ground when filling underground storage tanks. The device also provides a simple efficient structure for securing and supporting an inner container and outer skirt and cover which prevent surface water from entering the tank and mixing with the stored liquid. The tank may be made in many different sizes and shapes to meet various requirements and includes a resilient double gasket seal which permits vertical movement of the fill pipe with respect to the containment tank under varying weather and temperature conditions while maintaining the leak-proof seal. Means are also provided for emptying the liquid from the auxiliary tank into the main storage tank. While only a limited number of embodiments have been illustrated and described, it is apparent that many variations may be made in the particular design and configuration without departing from the scope of the invention as set forth in the appended claims.

What is claimed is:

1. An auxiliary containment tank for volatile liquids comprising:

an outer enclosure having vertically extending walls adapted to be mounted in the ground and having open ends at the top and bottom;

cover support means secured to said outer enclosure walls at said top open end and having an open area for receiving a cover;

an inner container having vertically extending walls spaced from said outer enclosure walls including an opening at the top end and a transversely extending wall across the bottom end, said outer enclosure walls and cover support means providing a space around said inner container;

means extending across said space for securing said inner container to said outer enclosure and cover support means; and a cover receivable in said open area of said cover support means over said opening at said top end, said cover having a vertical ring extending downwardly into said space between said outer enclosure and inner container around the outside of said inner container walls and below said opening at said top end of said inner container to prevent leakage of water around said cover into said inner container.

2. The containment tank of claim 1 including a fill pipe for an underground storage tank extending through said bottom wall, and resilient sealing means around said pipe sealingly securing said pipe to said bottom wall.

3. The containment tank of claim 2 including means disposed on said bottom wall for emptying liquid from said inner container into said fill pipe.

4. An auxiliary containment tank for volatile liquids comprising:

an outer enclosure having vertically extending walls adapted to be mounted in the ground and having open ends at the top and bottom;

cover support means secured to said outer enclosure walls at said top open end and having an open area for receiving a cover;

an inner container having vertically extending walls spaced from said outer enclosure walls including an opening at the top end and a transversely extending wall across the bottom end, said outer enclosure walls and cover support means providing a space around said inner container;

means extending across said space for securing said inner container to said outer enclosure and support means;

a cover receivable in said open area of said cover support means over said opening at said top end, said cover having a vertical ring extending downwardly into said space around the outside of said inner container walls and below said opening at said top end of said inner container to prevent leakage of water around said cover into said inner container;

a fill pipe for an underground storage tank extending through said bottom wall, and resilient sealing means around said pipe sealingly securing said pipe to said bottom wall; and means disposed on said bottom wall for emptying liquid from said inner container into said fill pipe.

5. The containment tank of claim 4 wherein said cover support means is an upper ring having a step for receiving said cover.

6. The containment tank of claim 5 wherein the top end of said inner container extends close to the top end of said outer enclosure providing said space therebetween, said means for securing said inner container to said outer enclosure and cover support means including a plurality of tabs disposed around the periphery of said inner container across said space, said cover vertical ring extending into said space over said tabs.

7. The containment tank of claim 4 wherein said cover support means is a horizontally extending upper plate including a ring secured to the bottom of said plate around said open area providing a step for receiving said cover, said open area being spaced inwardly from the periphery of said outer enclosure and plate.

8. The containment tank of claim 6 wherein said inner container and outer enclosure vertical walls are cylindrical and said cover is round.

9. The containment tank of claim 7 wherein said inner container includes an upper section adjacent to the top end having vertical walls of a smaller width than the remainder of the container vertical walls therebelow extending close to said outer enclosure walls, said smaller width section being disposed below said open area for said cover and providing said space between said ring at the bottom of said plate and said top end of said upper section, said means for securing said inner container and outer enclosure including a plurality of tabs disposed around the periphery of said upper section across said space, said cover vertical ring extending into said space above said tabs.

10. The containment tank of claim 9 wherein said horizontally extending plate and said outer enclosure and inner container vertically extending walls are rectangular, said smaller width section is cylindrical, and said cover is round.

11. The containment tank of claim 10 wherein said cover and smaller width section of said inner container are offset from the center of said upper plate and positioned closer to one side of said containment tank.

12. The containment tank of claim 4 wherein said means for emptying liquid includes a sump basin and a manually operable sump pump.

13. The containment tank of claim 4 wherein said means for emptying liquid is a manually operable normally closed drain valve.

14. The containment tank of claim 4 wherein the bottom of said inner container includes tapered walls directing liquid toward said means for emptying.

15. The containment tank of claim 4 wherein said cover includes holes permitting removal of said cover and an enclosed channel below said holes for preventing leakage of water into said inner container.

16. The containment tank of claim 4 wherein said sealing means includes a hollow double gasket having two inner spaced surfaces, a first ring secured to the bottom wall below said gasket, a second ring secured over said lower ring and gasket, said first and second rings having opposing steps receiving said gasket and securing said gasket around said pipe, said sealing means permitting vertical movement of said pipe with respect to said containment tank under varying temperature conditions while maintaining a seal therebetween.

17. The containment tank of claim 4 wherein the bottom end of said inner container extends close to the bottom end of said outer enclosure providing said space therebetween, said means for securing said inner container to said outer enclosure including a plurality of angle members secured around the lower periphery of said outer enclosure and including transverse extensions projecting inwardly across said space, said angle members including further transverse extensions projecting outwardly from said outer enclosure and adapted for securing said outer enclosure and containment tank within a concrete base.

18. An auxiliary containment tank for volatile liquids comprising:

an enclosure having vertically extending walls adapted to be mounted in the ground and having an open end at the top, and a bottom wall having an opening therein;

cover support means secured to said enclosure walls at said top open end;

a cover receivable in said cover support means over said top open end;

a fill pipe for an underground storage tank extending through said opening in said bottom wall, and resilient sealing means around said pipe sealingly securing said pipe to said bottom wall; and a sump basin in said bottom wall for collecting liquid, and a manually operable sump pump therein for emptying liquid from said enclosure.

* * * * *